US011352761B2

(12) United States Patent
Suzuki et al.

(10) Patent No.: US 11,352,761 B2
(45) Date of Patent: Jun. 7, 2022

(54) WORK MACHINE WITH JACKED-UP STATE CONTROL

(71) Applicant: HITACHI CONSTRUCTION MACHINERY CO., LTD., Tokyo (JP)

(72) Inventors: Yusuke Suzuki, Tsuchiura (JP); Hiroaki Tanaka, Kasumigaura (JP); Hisami Nakano, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 187 days.

(21) Appl. No.: 16/645,505

(22) PCT Filed: Sep. 3, 2018

(86) PCT No.: PCT/JP2018/032671
§ 371 (c)(1),
(2) Date: Mar. 9, 2020

(87) PCT Pub. No.: WO2020/049623
PCT Pub. Date: Mar. 12, 2020

(65) Prior Publication Data

US 2021/0148082 A1 May 20, 2021

(51) Int. Cl.

| | |
|---|---|
| ***E02F 3/43*** | (2006.01) |
| ***E02F 9/22*** | (2006.01) |
| ***E02F 9/26*** | (2006.01) |

(52) U.S. Cl.
CPC ..... *E02F 3/431* (2013.01); *E02F 9/2203* (2013.01); *E02F 9/2228* (2013.01); (Continued)

(58) Field of Classification Search
CPC ..... E02F 9/2203; E02F 9/2228; E02F 9/2267; E02F 9/2278; E02F 9/264
See application file for complete search history.

(56) References Cited

U.S. PATENT DOCUMENTS 6,450,081 B1 9/2002 Sorbel
8,768,581 B2 * 7/2014 Mizuochi ..... B66C 23/905 701/50

(Continued)

FOREIGN PATENT DOCUMENTS

CN 105735385 A 7/2016
CN 108138460 A 6/2018

(Continued)

OTHER PUBLICATIONS

Korean Office Action received in corresponding Korean Application No. 10-2020-7004933 dated Sep. 10, 2021.

(Continued)

*Primary Examiner* — Thomas E Lazo
(74) *Attorney, Agent, or Firm* — Mattingly & Malur, PC

(57) ABSTRACT

A work machine includes a controller (20) that performs an area restriction control for controlling at least one hydraulic cylinder (32*a*) of a plurality of hydraulic cylinders (32) in such a manner that a work device (400) is located on or on an upper side of an optionally set target surface (60) during operation of an operation lever (26). In the work machine, if a jack-up angle (φ) as an inclination angle of a machine body (1A) relative to a ground is larger than a preset target value (φt), the controller, in performing the area restriction control, corrects the control of the at least one hydraulic cylinder (32*a*) in such a manner that the jack-up angle approaches the target value. The target value is set such as to vary according to posture of an arm (406).

9 Claims, 10 Drawing Sheets

(52) U.S. Cl.
CPC ..... *E02F 9/2267* (2013.01); *E02F 9/2278* (2013.01); *E02F 9/264* (2013.01)

(56) References Cited

U.S. PATENT DOCUMENTS

| | | | | |
|---|---|---|---|---|
| 9,109,345 | B2 * | 8/2015 | Okamura | E02F 9/2207 |
| 9,518,370 | B2 * | 12/2016 | Tsukamoto | E02F 3/435 |
| 9,745,727 | B2 * | 8/2017 | Galan | E02F 9/24 |
| 2011/0318157 | A1 | 12/2011 | Okamura et al. | |
| 2012/0232763 | A1 | 9/2012 | Mizuochi et al. | |
| 2018/0266083 | A1 | 9/2018 | Narikawa et al. | |

FOREIGN PATENT DOCUMENTS

| | | | | |
|---|---|---|---|---|
| JP | 04-366235 | A | | 12/1992 |
| JP | 04366235 | A | * | 12/1992 |
| JP | 2983301 | B2 | | 11/1999 |
| JP | 2008-169640 | A | | 7/2008 |
| JP | 2014-122510 | A | | 7/2014 |
| JP | 2017-223096 | A | | 12/2017 |
| WO | 2011/049079 | A1 | | 4/2011 |

OTHER PUBLICATIONS

Chinese Office Action received in corresponding Chinese Application No. 201880054990.3 dated Jun. 21, 2021.
International Preliminary Report on Patentability received in corresponding International Application No. PCT/JP2018/032671 dated Mar. 18, 2021.
International Search Report of PCT/JP2018/032671 dated Nov. 27, 2018.

* cited by examiner

WORK MACHINE WITH JACKED-UP STATE CONTROL

TECHNICAL FIELD

The present invention relates to a work machine used for structure demolition work, road work, construction work, civil engineering work, or the like.

BACKGROUND ART

As a work machine used for structure demolition work, road work, construction work, civil engineering work, or the like, there has been known one in which an articulated work device including a plurality of front members is mounted to a main body and the front members are driven by hydraulic cylinders. Examples of such a work machine include a hydraulic excavator having a work device including a boom, an arm, a bucket, and the like. This type of hydraulic excavator includes one that is capable of executing what is generally called machine control in which an operational space for the work device is provided and the work device is semi-automatically operated within the space. For example, when a target surface of working is set at the boundary between the operational space and a non-operational space for the work device and the operator performs an arm operation, the work device can work semi-automatically along the working target surface by machine control.

In an excavation work using machine control by the hydraulic excavator, the boom and the bucket are semi-automatically operated according to a predetermined condition. Therefore, when a hard soil difficult to excavate smoothly is excavated by the work device, the excavation reaction force acting on the bucket from the ground is enlarged, easily resulting in what is generally called a jacked-up state in which an end portion on the farther side from the work device, of the track structure (crawler), and the bucket are grounded but an end portion on the nearer side to the work device, of the track structure, is in a floating state.

As a technology concerning the jack-up, Patent Document 1 discloses a technology in which a combined operation including an arm closing operation and a boom lowering operation by an operator is detected and the boom cylinder pressure is controlled in such a manner that the machine body is not jacked up. In this technology, the pressure of the hydraulic working fluid supplied to the boom cylinder is adjusted in such a manner as not to exceed the boom cylinder pressure at the time of jack-up of the work machine.

PRIOR ART DOCUMENT

Patent Document

Patent Document 1: JP-2014-122510-A

SUMMARY OF THE INVENTION

Problem to be Solved by the Invention

The angle formed between the ground and the track structure when the hydraulic excavator is in a jacked-up state may be referred to as a jack-up angle. The operator may intuitively grasp the magnitude of the excavating force from the magnitude of the jack-up angle and may adjust the excavating force. In the technology described in Patent Document 1, however, the boom cylinder pressure is always controlled in such a manner that the machine body is not jacked up. In other words, according to the technology of Patent Document 1, the jack-up angle is always kept substantially zero by the controller, irrespective of the operator's intention. Therefore, the operator cannot intuitively grasp the state of the excavating force from the magnitude of the jack-up angle, and it is difficult for the operator to adjust the excavating force by the operator's own operation. As a result, the work machine may be determined to be poor in operability, depending on the operator.

The present invention has been made in consideration of the above-mentioned problem. It is an object of the present invention to provide a work machine in which machine control is conducted and which is favorable in operability for the operator at the time of what is generally called a jacked-up state.

Means for Solving the Problem

In order to achieve the above object, the present invention provides a work machine including a machine body including a track structure and a swing structure, a work device having a boom and an arm and mounted to the swing structure, a plurality of hydraulic cylinders that are driven by hydraulic working fluid delivered from a hydraulic pump and that operate the work device, an operation device that gives an instruction on an operation of the work device according to an operation of an operator, and a controller that performs an area restriction control for controlling at least one hydraulic cylinder of the plurality of hydraulic cylinders in such a manner that the work device is located on or on an upper side of an optionally set target surface during operation of the operation device. If a jack-up angle as an inclination angle of the machine body relative to a ground is larger than a preset target value, the controller, in performing the area restriction control, corrects the control of the at least one hydraulic cylinder in such a manner that the jack-up angle approaches the target value, and the target value is set in such a manner as to vary according to posture of the arm.

Advantages of the Invention

According to the present invention, in an excavation work accompanied by machine control, operability and work efficiency can be enhanced, without over-excavating a target surface.

MODES FOR CARRYING OUT THE INVENTION

Figure 1:
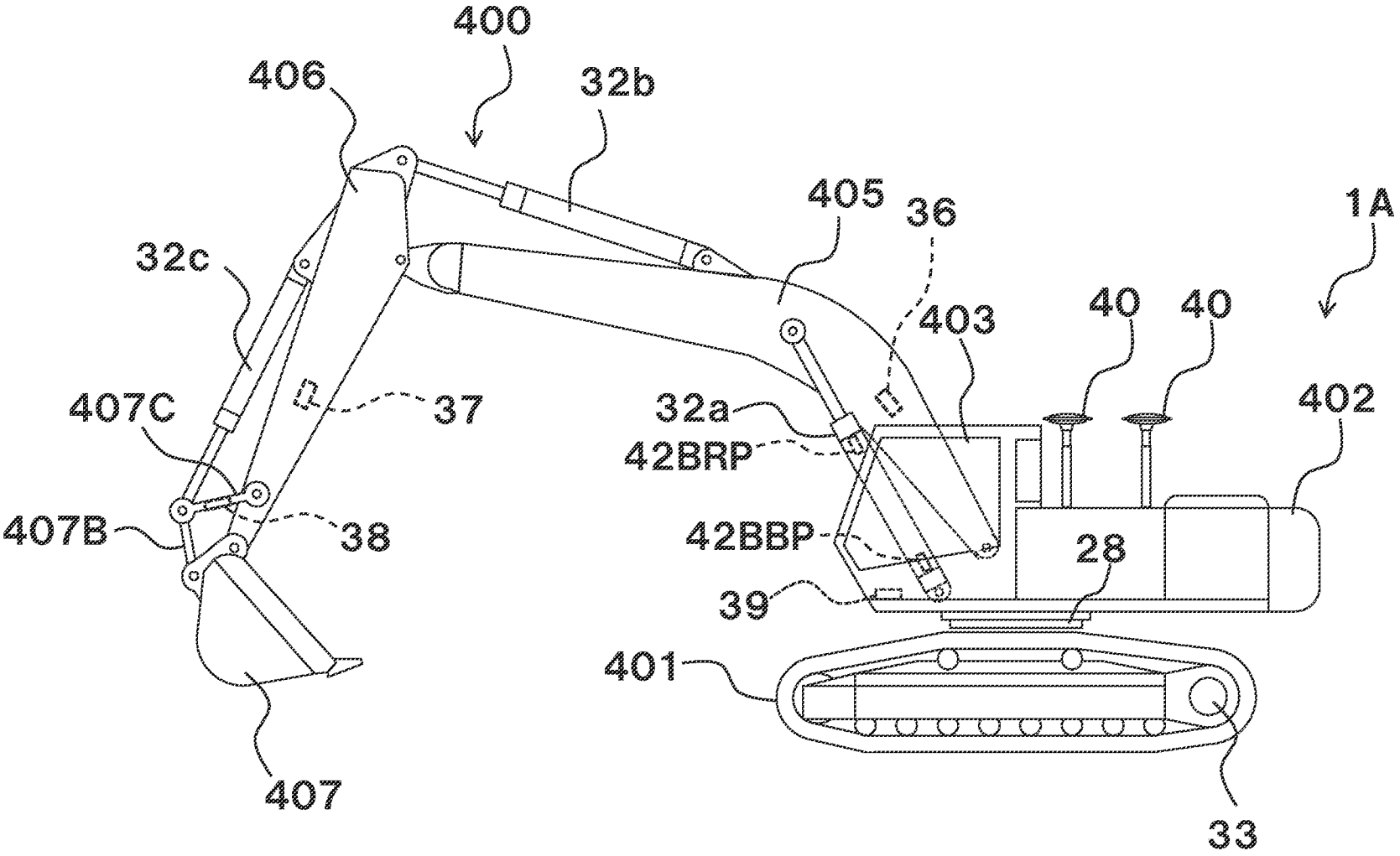
FIG. 1 is a side view of a hydraulic excavator according to an embodiment of the present invention.

An embodiment of the present invention will be described below referring to the drawings.

<Object Device>

FIG. 1 is a schematic configuration diagram of a hydraulic excavator according to an embodiment of the present invention. In FIG. 1, the hydraulic excavator includes a crawler type track structure 401, and a swing structure 402 swingably mounted to an upper portion of the track structure 401. The track structure 401 is driven by a track hydraulic motor 33. The swing structure 402 is driven by torque generated by a swing hydraulic motor 28, and is swung clockwise and counterclockwise.

Herein, a united body of the track structure 401 and the swing structure 402 may be referred to as a machine body 1A. The track structure 401 is not limited to the one that includes crawlers, and may be one that includes traveling wheels or one that includes bases.

A cab 403 is disposed on the swing structure 402, and an articulated front work device (work device) 400 capable of performing an operation of forming a target surface is mounted to the front side of the swing structure 402.

The front work device 400 includes a boom 405 driven by a boom cylinder (first hydraulic actuator) 32*a*, an arm 406 driven by an arm cylinder (second hydraulic actuator) 32*b*, and a bucket 407 driven by a bucket cylinder 32*c*. The boom cylinder 32*a*, the arm cylinder 32*b*, and the bucket cylinder 32*c* are each driven by a hydraulic working fluid delivered from a hydraulic pump 23, and operate the work device 400. Herein, the boom 405, the arm 406, and the bucket 407 may be referred to as front members.

In addition, the front work device 400 includes a first link 407B linking the bucket 407 and a tip portion of the bucket cylinder 32*c*, and a second link 407C linking the arm 406 and the tip portion of the bucket cylinder 32*c*. The bucket cylinder (hydraulic cylinder) 32*c* is linked to the second link 407C and the arm 406.

Note that the bucket 407 can optionally be replaced with work implements which are not illustrated such as a grapple, a breaker, a ripper, and a magnet.

A boom IMU (IMU: Inertial Measurement Unit) 36 and an arm IMU 37 for detecting postures (inclination angles) of the boom 405 and the arm 406 relative to a predetermined plane (for example, a horizontal plane) are attached respectively to the boom 405 and the arm 406. The second link 407C is provided with a bucket IMU 38 for detecting a posture (inclination angle) of the bucket 407 relative to the predetermined plane (for example, the horizontal plane) similarly to the above. The IMUs 36, 37, and 38 each include an angular velocity sensor and an acceleration sensor, and are capable of calculating an inclination angle.

An operation lever (operation device) 26 that gives an instruction on operations of the front work device 400, the swing structure 402 and the track structure 401 according to operator's operations, and an engine control dial 51 (see FIG. 2) that gives a command on a target revolving speed of an engine 21 (see FIG. 2) are disposed in the cab 403. The operation lever 26 generates control signals (pilot pressures (hereinafter also referred to as "Pi pressures") outputted from a gear pump 24 (see FIG. 2)) for the boom cylinder 32*a*, the arm cylinder 32*b*, the bucket cylinder 32*c*, the track hydraulic motor 33, and the swing hydraulic motor 28 according to an operating direction and an operating amount, and operates the boom 405, the arm 406, the bucket 407, the swing structure 402, and the track structure 401 by the control signals.

The Pi pressures outputted from the operation lever 26 are detected by pressure sensors 44, and the pressure sensors 44 output the detection values to a controller 20. The detection values from the pressure sensors 44 are used in the controller 20 for detection of the operating amount, the operating direction, and the operation object of the operation lever 26. In other words, the pressure sensors 44 function as operating amount sensors that detect operating input amounts for the operation lever 26. The number of the pressure sensors 44 is two times the number of control valves. Note that the operation lever 26 may be of an electric type. The detection of the operating amount, the operating direction, and the operation object by the operation lever 26 in this case is configured by operating amount sensors that detect the tilting amount (operating amount) of the operation lever 26. The operating amount sensors, by detecting the amounts by which the operator tilts the operation lever 26, can convert operation velocities required of the work device 400 by the operator into electrical signals.

Figure 2:
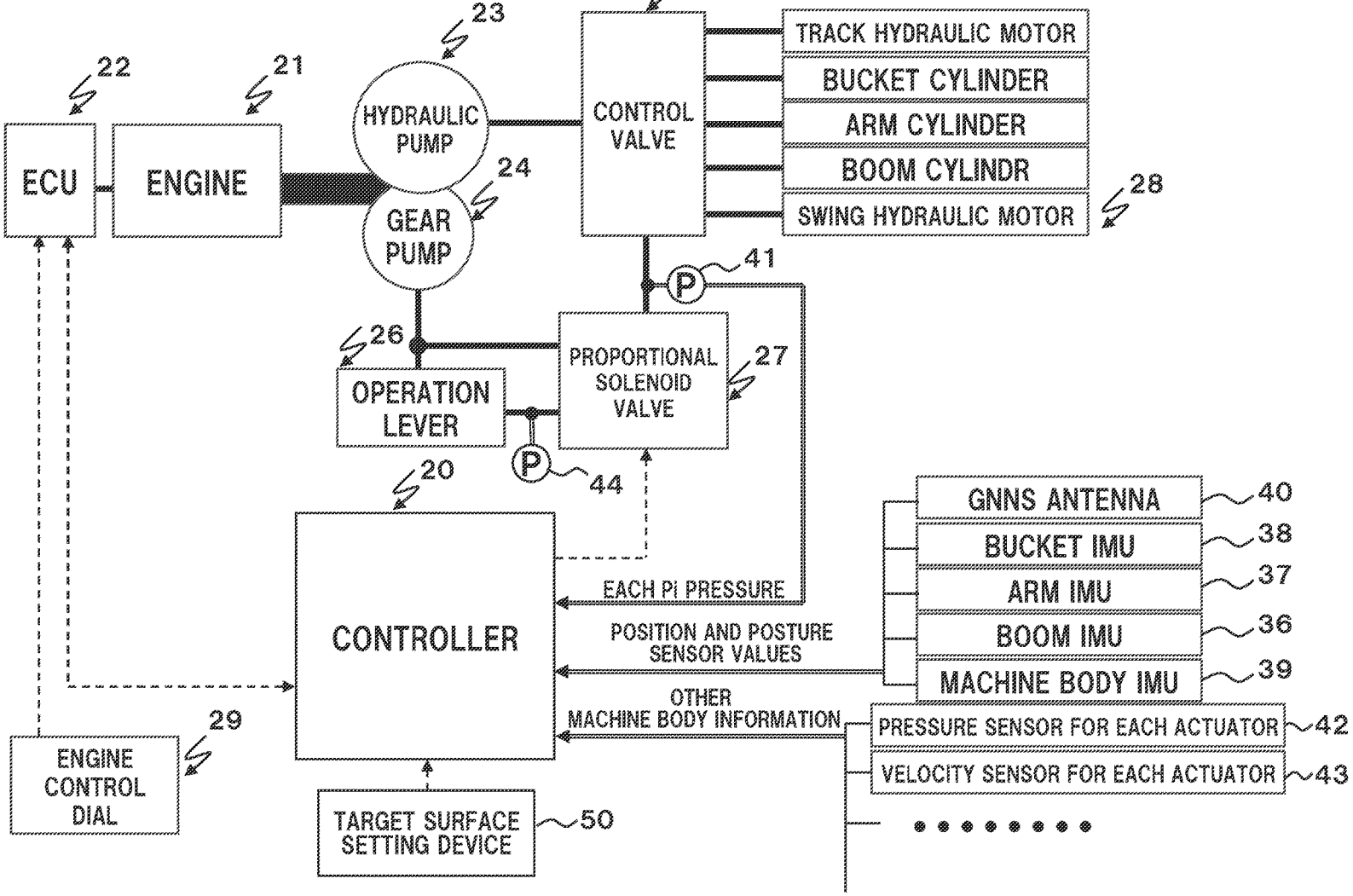
FIG. 2 is a system configuration diagram of the hydraulic excavator of FIG. 1.

FIG. 2 is a system configuration diagram of the hydraulic excavator of FIG. 1. The hydraulic excavator of the present embodiment includes the following: the engine 21; an engine control unit (ECU) 22 as a controller for controlling the engine 21; a hydraulic pump 23 and a gear pump (pilot pump) 24 mechanically connected to an output shaft of the engine 21 and driven by the engine 21; the operation lever 26 by which pressures obtained by decompressing a hydraulic fluid delivered from the gear pump 24 according to an operating amount are outputted to control valves 25 through proportional solenoid valves 27 as control signals for hydraulic actuators 28, 33, 32*a*, 32*b*, and 32*c*; a plurality of control valves 25 that control the flow rates and directions of hydraulic working fluids guided into the hydraulic actuators 28, 33, 32*a*, 32*b*, and 32*c* from the hydraulic pump 23, based on the control signals (pilot pressures (hereinafter also referred to as Pi pressures)) outputted from the operation lever 26 or the proportional solenoid valves 27; a plurality of pressure sensors 41 that detect pressure values of the Pi pressures acting on the control valves 25; the controller 20 that computes a corrected Pi pressure based on the position and posture of the front work device 400 and other machine body information and outputs a command voltage capable of generating the corrected Pi pressure to the proportional solenoid valves 27; and a target surface setting device 50 for inputting to the controller 20 information concerning a target surface which is a target shape of an object of work by the front work device 400.

In regard of the hydraulic pump 23, the torque and the flow rate are mechanically controlled such that the machine body is operated according to target outputs (described later) of the hydraulic actuators 28, 33, 32*a*, 32*b*, and 32*c*.

While the control valves 25 are present in the same number as that of the hydraulic actuators 28, 33, 32*a*, 32*b*, and 32*c* as objects to be controlled, they are depicted collectively as one valve in FIG. 2. On each of the control valves, two Pi pressures that move a spool inside the control valve in one or the other of axial directions act. For example, on the control valve 25 for the boom cylinder 32*a*, a boom raising Pi pressure and a boom lowering Pi pressure act.

The pressure sensors 41 detect the Pi pressures acting on the control valves 25, and are present in a number that is twice the number of the control valves. The pressure sensors 41 are provided directly under the control valves 25, and detect the Pi pressures actually acting on the control valves 25.

While the proportional solenoid valves 27 are present in plural numbers, they are depicted collectively as one block in FIG. 2. The proportional solenoid valves 27 are of two kinds. One is a pressure reducing valve that outputs the Pi pressure inputted from the operation lever 26 as it is or that reduces it to a desired corrected Pi pressure designated by a command voltage and outputs the reduced Pi pressure. The other is a pressure increasing valve that, when a Pi pressure higher than the Pi pressure outputted from the operation lever 26 is needed, reduces the Pi pressure inputted from the gear pump 24 to a desired corrected Pi pressure designated by a command voltage and outputs the reduced Pi pressure. In regard of a Pi pressure for a certain control valve 25, a Pi pressure is generated through the pressure increasing valve when a Pi pressure higher than the Pi pressure outputted from the operation lever 26 is needed, a Pi pressure is generated through the pressure reducing valve when a Pi pressure lower than the Pi pressure outputted from the operation lever 26 is needed, and a Pi pressure is generated through the pressure increasing valve when no Pi pressure is outputted from the operation lever 26. In other words, by the pressure reducing valve and the pressure increasing valve, a Pi pressure of a pressure value different from that of the Pi pressure inputted from the operation lever 26 (a Pi pressure based on the operator's operation) can be made to act on the control valve 25, and the hydraulic actuator which is the object of control by the control valve 25 can be made to perform a desired operation.

For each control valve 25, there can be at most two pressure reducing valves and at most two pressure increasing valves. In the present embodiment, two pressure reducing valves and two pressure increasing valves are provided for the control valve 25 for the boom cylinder 32*a*, and one pressure reducing valve is provided for the control valve 25 for the arm cylinder 32*b*. Specifically, the hydraulic excavator is provided with a first pressure reducing valve provided in a first line for guiding a boom raising Pi pressure from the operation lever 26 to the control valve 25, a first pressure increasing valve provided in a second line for guiding the boom raising Pi pressure from the gear pump 24 to the control valve 25 by bypassing the operation lever 26, a second pressure reducing valve provided in a third line for guiding the boom lowering Pi pressure from the operation lever 26 to the control valve 25, a second pressure increasing valve provided in a fourth line for guiding the boom lowering Pi pressure from the gear pump 24 to the control valve 25 by bypassing the operation lever 26, and a third pressure reducing valve provided in a fifth line for guiding an arm crowding Pi pressure from the operation lever 26 to the control valve 25.

The proportional solenoid valve 27 in the present embodiment is provided only for the control valves 25 for the boom cylinder 32*a* and the arm cylinder 32*b*, and there is no proportional solenoid valve 27 for the control valves 25 for the other actuators 28, 33, and 32*c*. Therefore, the bucket cylinder 32*c*, the swing hydraulic motor 28, and the track hydraulic motor 33 are driven based on a Pi pressure outputted from the operation lever 26.

Note that herein the Pi pressures inputted to the control valves 25 for the boom cylinder 32*a* and the arm cylinder 32*b* (control signals for the boom and the arm) are all referred to as a "corrected Pi pressure" (or a corrected control signal), irrespective of the presence or absence of correction of the Pi pressure by the proportional solenoid valve 27.

In addition, herein, a control of the boom cylinder 32*a* and the arm cylinder 32*b* based on the Pi pressure corrected by the proportional solenoid valve 27, for operating the front work device 400 according to a predetermined condition during operation of the operation lever 26, may be referred to as machine control (MC). For example, in the present embodiment, as MC, an area restriction control of controlling at least one hydraulic cylinder of the plurality of hydraulic cylinders 32*a*, 32*b*, and 32*c* can be performed such that the front work device 400 (in the present embodiment, the bucket 407) is located in an area on or on an upper side of an optionally set target surface 60 (see FIG. 5). Besides, herein, the MC may be referred to as "semi-automatic control" of controlling the operation of the front work device 400 by the controller 20 only when the operation lever 26 is operated, as contrasted with "automatic control" of controlling the operation of the front work device 400 by the controller 20 when the operation lever 26 is not operated.

The controller 20 includes an input section, a central processing unit (CPU) which is a processor, a read only memory (ROM) and a random access memory (RAM) as a memory, and an output section. The input section converts various kinds of information inputted to the controller 20 into a form that can be calculated by the CPU. The ROM is a recording medium in which a control program for executing calculation processes described later, various kinds of information required for execution of the calculation processes, and the like are stored. The CPU performs predetermined calculation processes on signals taken in from the input section, the ROM, and the RAM according to the control program stored in the ROM. The output section outputs a command for driving the engine 21 at a target revolving speed, a command necessary for causing a command voltage to act on the proportional solenoid valve 27, and the like. Note that the memory is not limited to semiconductor memories such as the ROM and the RAM mentioned above, and may be replaced, for example, with a magnetic storage such as a hard disk drive.

The ECU 22, the plurality of pressure sensors 41, two GNSS antennas 40, the bucket IMU 38, the arm IMU 37, the boom IMU 36, a machine body IMU 39, a plurality of pressure sensors 42 for detecting the pressures of the hydraulic actuators 28, 33, 32*a*, 32*b*, and 32*c*, a plurality of velocity sensors 43 for detecting operation velocities of the hydraulic actuators 28, 33, 32*a*, 32*b*, and 32*c*, and the target surface setting device 50 are connected to the controller 20.

The controller 20 computes the positions and directions (orientations) of the swing structure 402 and the front work device 400 in a global coordinate system (geographic coordinate system) and the target surface 60 based on input signals from the two GNSS antennas 40, and computes the posture of the front work device 400 based on input signals from the bucket IMU 38, the arm IMU 37, the boom IMU 36, and the machine body IMU 39. In other words, in the present embodiment, the GNSS antennas 40 function as position sensors, whereas the bucket IMU 38, the arm IMU 37, the boom IMU 36, and the machine body IMU 39 function as posture sensors.

In the present embodiment, stroke sensors are used as the velocity sensors 43 for the hydraulic cylinders 32*a*, 32*b*, and 32*c*. In addition, the hydraulic cylinders 32*a*, 32*b*, and 32*c* are each provided with a bottom pressure sensor and a rod pressure sensor as the pressure sensors for the hydraulic cylinders 32*a*, 32*b*, and 32*c*. Here, the pressure sensor 42 for detecting the bottom pressure of the boom cylinder 32*a* may be referred to as a boom bottom pressure sensor 42BBP, and the pressure sensor 42 for detecting the rod pressure of the boom cylinder 32*a* may be referred to as a boom rod pressure sensor 42BRP.

Note that the means and method used in computing the machine body position, the posture of the front work device 400, the pressures of the actuators, and the velocities of the actuators described herein are merely an example, and known computing means and methods can be used.

The target surface setting device 50 is an interface through which information concerning the target surface 60 (see FIGS. 3 and 5) (inclusive of position information and inclination angle information concerning each target surface) can be inputted. The target setting device 50 is connected to an external terminal (not illustrated) in which three-dimensional data of a target surface prescribed on a global coordinate system (geographic coordinate system) is stored, and the information concerning the target surface inputted from the external terminal is stored into the memory in the controller 20 through the target setting device 50. Note that the inputting of the target surface through the target surface setting device 50 may be performed manually by the operator.

<Jack-Up>

Figure 3:
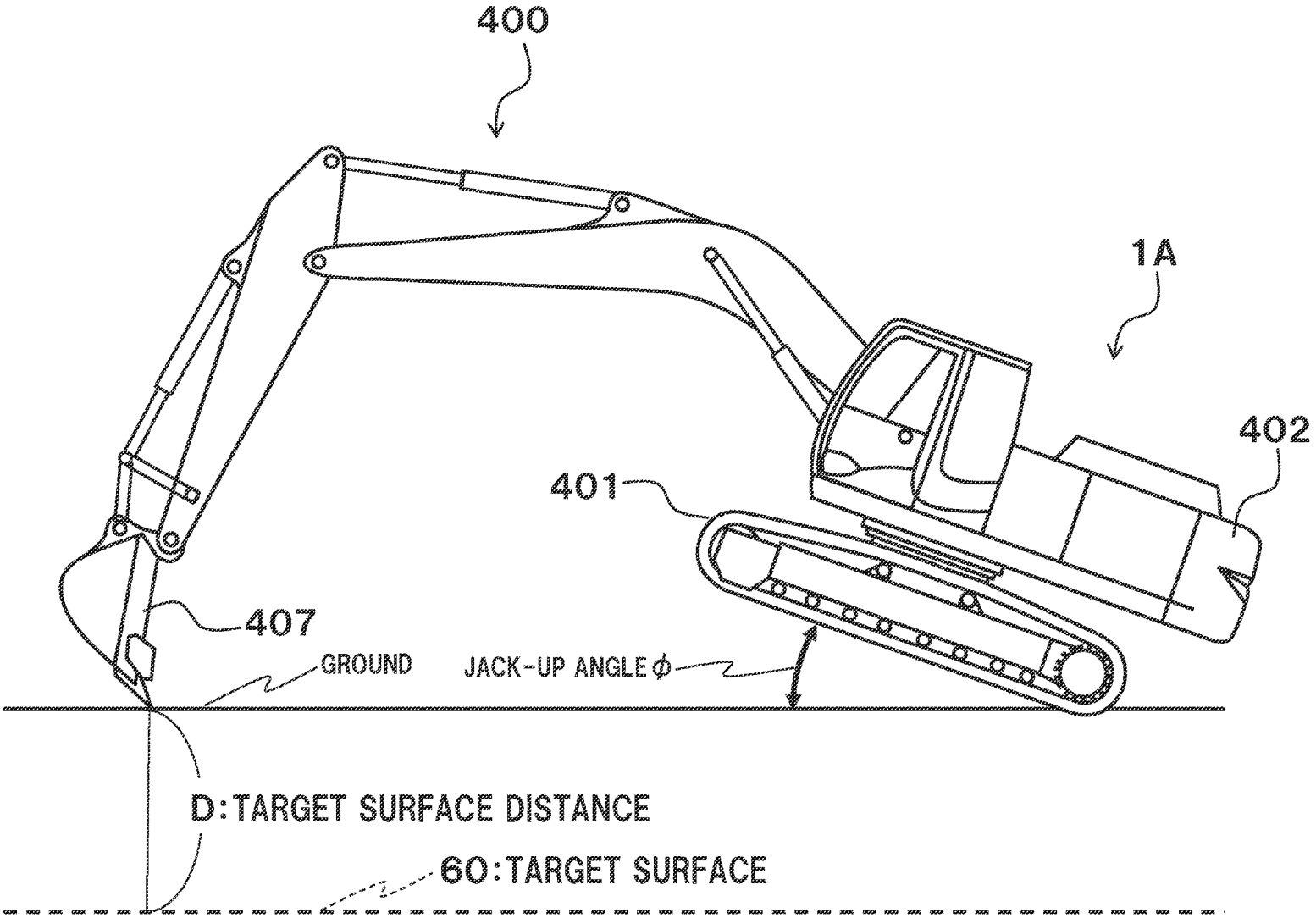
FIG. 3 is a side view depicting a jacked-up state of the hydraulic excavator.

As illustrated in FIG. 3, jack-up (a jacked-up state) of the machine body 1A is a state in which a rear end (an end portion farther from the work device 400) of the track structure 401 and the bucket 407 are grounded and a front end (an end portion nearer to the work device 400) of the track structure 401 is floated in the air. In this instance, the inclination angle of the track structure 401 (the machine body 1A) relative to the ground is referred to as a jack-up angle φ. When the jack-up angle φ is zero, it is a state in which a bottom surface of the track structure 401 is grounded in its entirety.

Note that since the swing structure 402 can be swung relative to the track structure 401, the directions of the swing structure 402 and the track structure 401 may be opposite to those illustrated or in a lateral direction, depending on the working posture. In this case as well, the inclination angle of the track structure 401 relative to the ground is defined as the jack-up angle φ. In the present embodiment, for ease of calculation, the distance between a front idler and a sprocket of the track structure 401 and the distance between the left and right crawlers are assumed to be the same distance in calculations.

<Controller>

Figure 4:
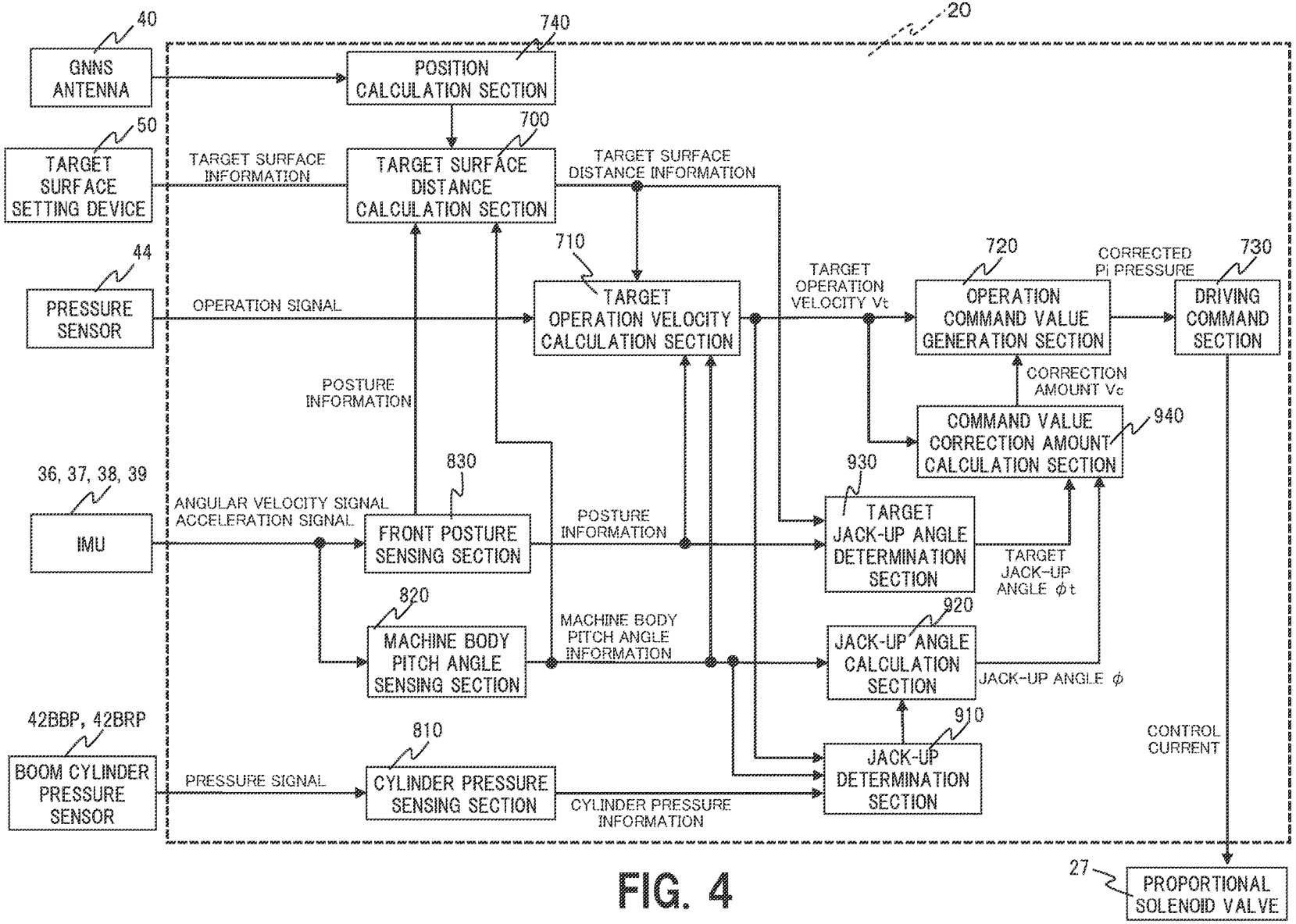
FIG. 4 is a diagram depicting the functional configuration of a controller.

FIG. 4 is a diagram (functional block diagram) in which the contents of programs executed by the controller 20 are depicted in blocks. As depicted in this figure, the controller 20 functions as a position calculation section 740, a target surface distance calculation section 700, a target operation velocity calculation section 710, an operation command value generation section 720, a driving command section 730, a cylinder pressure sensing section 810, a machine body pitch angle sensing section 820, a front posture sensing section 830, a jack-up determination section 910, a jack-up angle calculation section 920, a target jack-up angle determination section 930, and a command value correction amount calculation section 940.

The position calculation section 740 of the controller 20 calculates the positions and orientations of the swing structure 402 and the work device 400 in the global coordinate system from signals (navigation signals) received by the two GNSS antennas 40.

The machine body pitch angle sensing section 820 detects and calculates a pitch angle (inclination angle) of the swing structure 402 based on an acceleration signal and an angular velocity signal obtained from the machine body IMU 39 attached to the swing structure 402.

The front posture sensing section 830 estimates respective postures of the boom 405, the arm 406, and the bucket 407, based on acceleration signals and angular velocity signals obtained from the boom IMU 36, the arm IMU 37, and the bucket IMU 38.

The target surface distance calculation section 700 receives as inputs the positions and the orientations of the swing structure 402 and the work device 400 calculated by the position calculation section 740, the pitch angle of the swing structure 402 calculated by the machine body pitch angle sensing section 820, the postures of the front members 405, 406, and 407 calculated by the front posture sensing section 830, and a three-dimensional shape of the target surface 60 inputted from the target surface setting device 50. The target surface distance calculation section 700 generates a sectional view (two-dimensional shape) of the target surface obtained when the three-dimensional target surface 60 is cut by a plane parallel to the swing axis of the swing structure 402 and passing through the center of gravity of the bucket 407 from these pieces of input information, and computes the distance (target surface distance) D between the claw tip position of the bucket 407 and the target surface 60 in this section. The distance D is the distance between the intersection of a perpendicular dropped from the claw tip of the bucket 407 to the target surface 60 and this section and the claw tip (tip) of the bucket 407.

The target operation velocity calculation section 710 calculates a target value (target operation velocity) Vt of the velocity of at least one hydraulic cylinder of the plurality of hydraulic cylinders 32*a*, 32*b*, and 32*c* necessary for operating the work device 400 such that the claw tip 407*a* of the bucket 407 is moved along the target surface 60 (i.e., necessary for performing the area restriction control). In the present embodiment, for ease of description, description will be made by taking as an example a case where the operator only operates the arm 406 by the operation lever 26 (i.e., the operator does not operate the boom 405 or the bucket 407) in an excavation work of the work device 400, and the velocity vector V1 generated at the bucket claw tip 407*a* by the arm operation is corrected only by an operation of the boom cylinder 32*a* by MC, whereby the bucket claw tip 407*a* is moved along the target surface 60.

First, the target operation velocity calculation section 710 computes a limit value (limit velocity perpendicular component) V1'y of a component perpendicular to the target surface 60, of a velocity vector of the bucket claw tip 407*a* (this component will hereinafter simply be referred to as a "perpendicular component"), based on the distance D calculated by the target surface distance calculation section 700 and a table in FIG. 6. The limit value here means a lower limit value, and values smaller than the limit value are set to the limit value. The limit velocity perpendicular component V1'y is set to be 0 when the distance D is 0, and to decrease monotonously with an increase in the distance D; the limit velocity perpendicular component V1'y is set to be $-\infty$, so that restriction is substantially not applied (namely, a velocity vector with a freely-selected perpendicular component can be outputted), when the distance D exceeds a predetermined value d1. The method of determining the limit velocity perpendicular component V1'y is not limited to the table of FIG. 6, but may be replaced by any one as long as the limit velocity perpendicular component V1'y decreases monotonously at least in a range of the distance D from 0 to a predetermined positive value.

Next, the target operation velocity calculation section 710 calculates velocities of the hydraulic cylinders 32*a*, 32*b*, and 32*c* based on operation signals (operating amounts) inputted from the pressure sensors 44 (velocities of the hydraulic cylinders 32*a*, 32*b*, and 32*c* based on the operator's operation). This calculation can be performed, for example, by use of a correlation table for converting the operating amount of the operation lever 26 into cylinder velocity. Then, taking into account posture information concerning the work device 400 inputted from the front posture sensing section 830 and pitch angle information concerning the machine body 1A inputted from the machine body pitch angle sensing section 820, in addition to this velocity, a velocity vector V1 generated at the bucket claw tip by the velocities of the hydraulic cylinders 32*a*, 32*b*, and 32*c* is calculated. In the present embodiment, only the arm cylinder 32*b* is operated by the operation lever 26, and, therefore, the velocity vector V1 is generated at the bucket claw tip 407*a* only by the operation of the arm cylinder 32*b*.

Figure 5:
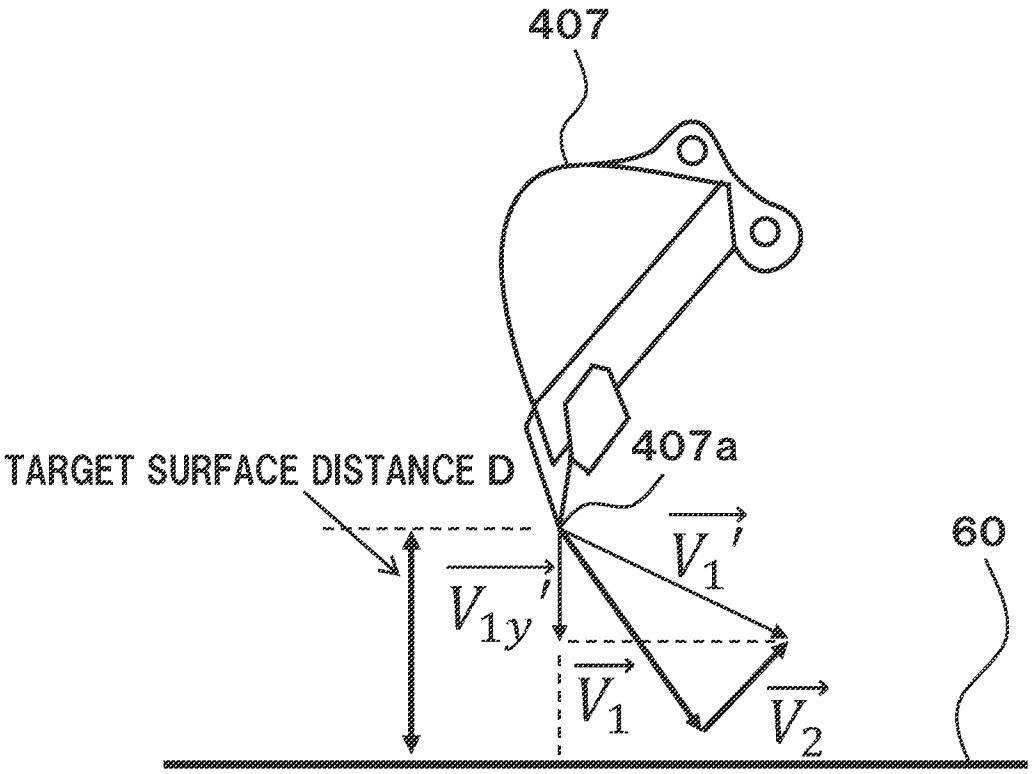
FIG. 5 is an explanatory diagram of locus correction for a bucket claw tip.

As illustrated in FIG. 5, in the present embodiment, a velocity vector V2 is generated at the bucket claw tip 407*a* by MC, and V2 is added to the velocity vector V1 of the bucket claw tip 407*a*, whereby the velocity vector of the claw tip of the bucket 407 is corrected to V1' such that the perpendicular component of the velocity vector of the claw tip of the bucket 407 is maintained at the target velocity perpendicular component V1'y. The target operation velocity calculation section 710 in the present embodiment generates the velocity vector V2 only by an operation (boom raising operation) of the boom cylinder 32*a*. Then, the target operation velocity calculation section 710 computes a post-correction target velocity for each of the cylinders 32*a*, 32*b*, and 32*c* as a target operation velocity Vt. In the present embodiment, let pre-correction velocities (Voa, Vob, and Voc) of the cylinders 32*a*, 32*b* and 32*c* be (0, Vb1, and 0) and let a post-correction velocity (target operation velocity Vta) of the boom cylinder 32*a* be Va1, then the target operation velocities (Vta, Vtb, and Vtc) of the cylinders 32*a*, 32*b*, and 32*c* are (Va1, Vb1, and 0).

In the case of FIG. 5, the vector V1 is a pre-correction velocity vector of the bucket claw tip that is computed from cylinder velocity information of each of the hydraulic cylinders 32*a*, 32*b*, and 32*c* calculated from an operation signal (operating amount) inputted from the pressure sensor 44, posture information inputted from the front posture sensing section 830, and machine body pitch angle information inputted from the machine body pitch angle sensing section 820. The perpendicular component of this vector V1 is the same in direction as the target velocity perpendicular component V1'y, but its magnitude exceeds the magnitude of the limit value V1'y, and therefore, by adding a velocity vector V2 generated by boom raising, the vector V1 should be corrected such that the perpendicular component of the post-correction bucket claw tip velocity vector will be V1'y. The direction of the vector V2 is a tangential direction of a circle whose radius is the distance from the rotational center of the boom 405 to the bucket claw tip 407*a*, and the direction can be computed from the posture of the front work device 400 in that instance. Besides, a vector which has the thus computed direction and which has such a size that, by adding it to the pre-correction vector V1, the perpendicular component of the post-correction vector V1' becomes V1'y is determined as V2. Note that the size of V2 may be obtained by applying cosine theorem using the sizes of V1 and V1' and the angle θ between V1 and V1'.

Figure 6:
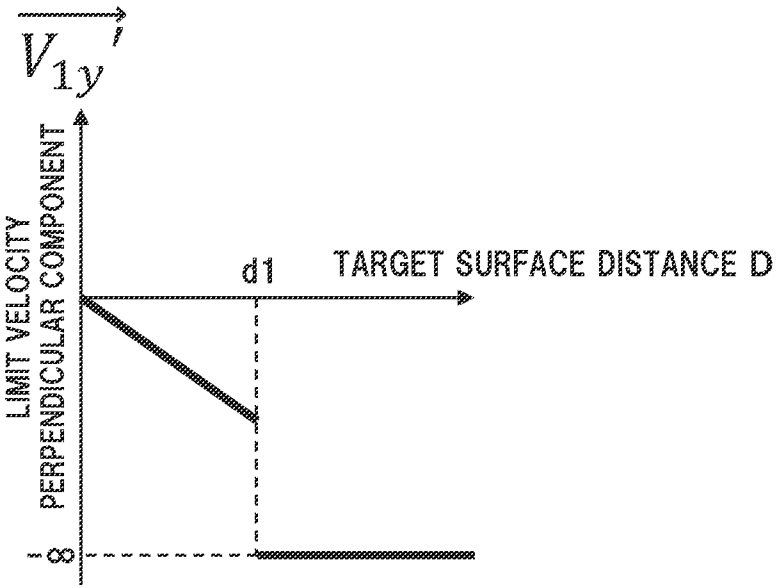
FIG. 6 is a diagram depicting a calculation table of limit velocity perpendicular component V1y'.

When the target velocity perpendicular component V1'y of the claw tip velocity vector is determined as in the table of FIG. 6, the perpendicular component of the claw tip velocity vector gradually approaches 0 as the bucket claw tip 407*a* approaches the target surface 60, and, therefore, the claw tip 407*a* can be prevented from penetrating into the lower side of the target surface 60.

The operation command value generation section 720 calculates corrected Pi pressures (operation command value Pi) to be outputted to the control valves 25 corresponding to the cylinders 32*a*, 32*b*, and 32*c*, for operating the cylinders 32*a*, 32*b*, and 32*c* at the target operation velocities (Vta, Vtb, and Vtc) calculated by the target operation velocity calculation section 710. It is to be noted, however, that in the case where there is a correction amount (correction operation velocity) Vc that the command value correction amount calculation section 940 commands, this correction amount is added to the target operation velocity Vt to compute a corrected Pi pressure (see Formula (3) described later). In the present embodiment, the correction amount Vc may be calculated for only the target operation velocity Vta of the boom cylinder 32*a*, and the target operation velocities Vtb and Vtc of the remaining arm cylinder 32*b* and bucket cylinder 32*c* are not corrected.

The driving command section 730 generates a control current necessary for driving the proportional solenoid valve 27, based on the corrected Pi pressure generated by the operation command value generation section 720, and outputs the control current to the proportional solenoid valve 27. As a result, the corrected Pi pressures act on the control valves 25, and the cylinders 32*a*, 32*b*, and 32*c* are operated at the target operation velocities Vt (Vta, Vtb, and Vtc). When the correction amount Vc is zero (when the jack-up angle φ is equal to or less than the target value φt), the bucket claw tip 407*a* is operated along the target surface 60. When a correction amount Vc is present for the target operation velocity Vta of the boom cylinder 32*a* (when the jack-up angle φ is larger than the target value φt), the bucket claw tip 407*a* is operated such as to draw a locus on an upper side than that in the case where the correction amount Vc is zero. Therefore, when the correction amount Vc is present for the target operation velocity Vta of the boom cylinder 32*a*, such an operation that the jack-up angle φ is reduced to approach the target value φt is performed.

The cylinder pressure sensing section 810 receives as inputs pressure signals from the bottom pressure sensor 42BBP and the rod pressure sensor 42BRP attached respectively to the bottom-side oil chamber and the rod-side oil chamber of the boom cylinder 32*a*, and detects a bottom pressure Pbb and a rod pressure Pbr of the boom cylinder 32*a*.

<Determining Method for Jack-up>

The jack-up determination section 910 determines whether or not the hydraulic excavator 1 is in a jacked-up state, based on the target operation velocity Vt obtained from the target operation velocity calculation section 710, cylinder pressure information (the rod pressure Pbr and the bottom pressure Pbb of the boom cylinder 32*a*) obtained from the cylinder pressure sensing section 810, and machine body pitch angle information obtained from the machine body pitch angle sensing section 820. The details of this determining method will be described below.

The determination of whether or not the hydraulic excavator 1 is in a jacked-up state is performed by use of the target operation velocity Vt, the rod pressure Pbr and the bottom pressure Pbb of the boom cylinder, and the machine body pitch angle information. When the machine body 1A is not jacked up, the weight of the work device 400 is supported by the boom cylinder 32*a*. Therefore, the bottom pressure Pbb of the boom cylinder 32*a* is higher than the rod pressure Pbr of the boom cylinder 32*a* (that is, Pbb>Pbr). It is to be noted, however, that, in a strict sense, a thrust force of the cylinder as a whole is determined in proportion to pressure receiving areas of the bottom-side oil chamber and the rod-side oil chamber. However, here, description will be made on the assumption that the pressure receiving areas of the bottom-side oil chamber and the rod-side oil chamber are equal.

On the other hand, when the machine body 1A is jacked up, part of the weight of the swing structure 402 and the track structure 401 is supported by the work device 400, so that the bottom pressure Pbb of the boom cylinder 32*a* is lower than the rod pressure Pbr of the boom cylinder 32*a* (that is, Pbb<Pbr). Then, when the differential pressure between the bottom side and the rod side in the boom cylinder 32 is smaller than a predetermined threshold (pressure threshold) P1 (that is, Pbb−Pbr<P1), it can be determined that the machine body 1A is in a jacked-up state.

The threshold P1 of the differential pressure in this instance can be obtained from a support force for supporting the mass of the components of the hydraulic excavator 1 and a thrust force of the boom cylinder 32*a* figured from the bottom pressure Pbb and the rod pressure Pbr of the boom cylinder 32*a*; alternatively, the threshold P1 may be obtained from the differential pressure between the bottom pressure Pbb and the rod pressure Pbr of the boom cylinder 32*a* which are measured when the machine body 1A is actually jacked up. In addition, the bottom pressure when the machine body 1A is jacked up may preliminarily be measured by an experiment, and the machine body 1A may be determined to be in a jacked-up state, based on a situation in which the bottom pressure is lowered than the measured value. Note that the threshold P1 can be set to zero.

Incidentally, by the above-mentioned method, the state in which the machine body 1A is jacked up can be determined correctly if the machine body 1A is in a static state. However, when the boom 405 is suddenly moved downward from a state of standing still in the air, only the bottom pressure Pbb of the boom cylinder 32*a* may suddenly be lowered for a short period of time, on the basis of the structure of the hydraulic system. As a result, the bottom pressure of the boom cylinder 32*a* is lowered below the rod pressure, possibly resulting in an erroneous determination that the machine body 1A is in a jacked-up state.

In view of this, at the time of applying the present embodiment to an actual machine, it is preferable to add the following two determinations, from the viewpoint of avoiding erroneous determination.

A first determination is to determine that the machine body 1A is not jacked up, even if the differential pressure between the bottom side and the rod side in the boom cylinder 32*a* is smaller than the threshold P1, during a period until a predetermined time T1 elapses from the time when a lowering operation for the boom 405 is started in response to an input of a boom lowering operation to the operation lever 26. The time T1 can be determined by preliminarily measuring the period of time in which the bottom pressure Pbb is suddenly lowered by a boom lowering operation and there is a possibility of erroneous determination, and determining the time T1 based on the measured period of time.

Another determination utilizes the fact that the pitch angle of the hydraulic excavator 1 is slightly changed when the bucket 407 get grounded. Specifically, during a period until a predetermined time T1 elapses from the time when a lowering operation of the boom 405 is started, it is determined whether or not the change in the machine body pitch angle has been equal to or more than a predetermined amount (change threshold) θ1, and, if there has been a change that is equal to or more than the predetermined amount θ1, it is determined that the machine body 1A is in a jacked-up state.

By adding the above-mentioned two determinations, it is possible to correctly determine whether or not the machine body 1A is in a jacked-up state.

The jack-up angle calculation section 920 calculates the jack-up angle φ of the hydraulic excavator 1, based on jack-up state information of the hydraulic excavator 1 obtained from the jack-up determination section 910 and machine body pitch angle information obtained from the machine body pitch angle sensing section 820. Examples of the calculating method for the jack-up angle φ include a method in which the machine body pitch angle calculated based on a detection value from the machine body IMU (inclination angle sensor) 39 immediately before the time of change from a determination of a non-jacked-up state by the jack-up determination section 910 to a determination of a jacked-up state by the jack-up determination section 910 is deemed as an inclination angle of the ground, and in which the deviation between the inclination angle and a current inclination angle is made to be the jack-up angle φ. In addition, when the shape of the ground can be measured by a stereo camera, a laser scanner, or the like and the inclination angle of the ground can be acquired, the deviation between the inclination angle and the machine body pitch angle can be made to be the jack-up angle φ. Also when three-dimensional data of a newest ground shape is stored in the target surface setting device 50, the jack-up angle φ can be calculated.

<Determination of Target Jack-up Angle by Operation Analysis>

The target jack-up angle determination section 930 determines a target jack-up angle φt for the hydraulic excavator 1, based on the target operation velocity Vt obtained from the target operation velocity calculation section 710 and the posture information obtained from the front posture sensing section 830. In the present embodiment, a configuration in which the target jack-up angle φt is varied according to the angle (posture) of the arm 406 is adopted.

Figure 7:
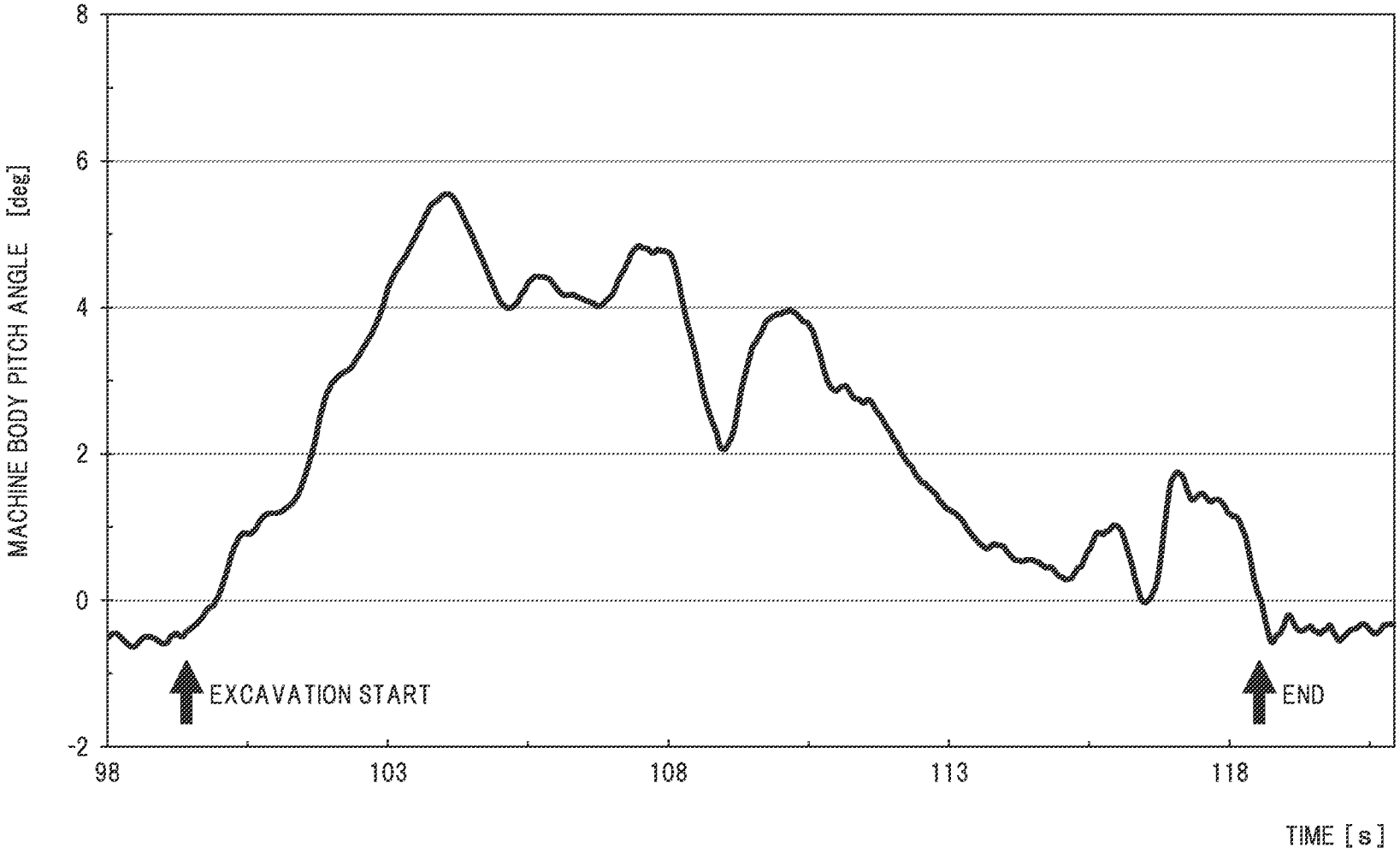
FIG. 7 is a diagram depicting machine body pitch angle obtained by analyzing an excavation work by a skilled operator.

FIG. 7 depicts variation in the machine body pitch angle during times when a skilled operator is excavating a hard soil. As illustrated in FIG. 7, it has been known that in an excavating operation by a skilled operator when excavating a hard soil, the jack-up angle φ is large at the start of excavation and the jack-up angle φ is small at the end of excavation. This is because, at the start of excavation, jack-up is conducted to a great extent to ensure that the operator can grasp the state of the soil and can feel the excavating force, which influences operability. On the other hand, at the end of excavation, jack-up is not conducted for realizing swift transition to the transport operation by a boom raising operation following the excavating operation and for enhancing work efficiency. According to this, in the present embodiment, the target jack-up angle φt is set to a maximum of 6 degrees at the start of excavation and is set to 0 degrees (non-jacked-up state) at the end of excavation.

Figure 9:
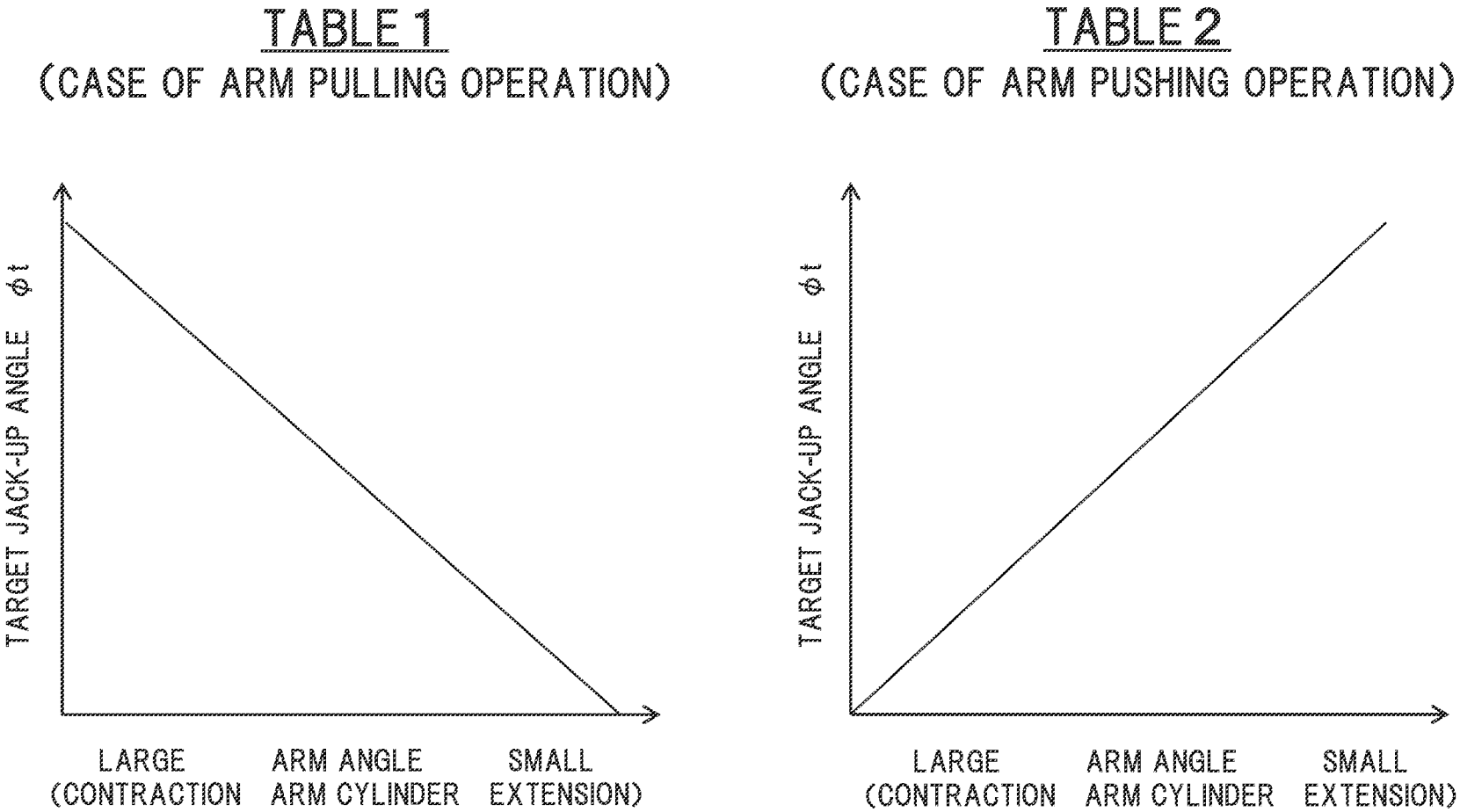
FIG. 9 is a diagram depicting the correlation between an arm angle and a target jack-up angle φt.

In addition, the excavating operation is conducted by two operations of arm pulling and arm pushing. In view of this, in the present embodiment, a case where excavation is performed by an arm pulling operation and a case where excavation is performed by an arm pushing operation are considered as two different cases, and correlation tables in which correlation between the arm angle and the target jack-up angle φt is prescribed are stored. FIG. 9 is a diagram depicting the correlation tables in which the correlation between the arm angle and the target jack-up angle φt in the present embodiment is prescribed. Table 1 at the left in the figure is the correlation table in the case of the arm pulling operation, and Table 2 at the right in the figure is the correlation table in the case of the arm pushing operation. The "arm angle" represented by the axis of abscissas in each of the tables is such that the angle of the arm 406 is at a minimum when the tip of the arm 406 is folded to be closest to the boom 405 (when the length of the arm cylinder 32*b* is extended to a maximum) and that the angle of the arm 406 is at a maximum when the tip of the arm 406 is extended to be spaced most from the boom 405 (when the length of the arm cylinder 32*b* is contracted to a minimum). In other words, the table at the left in FIG. 9 is a table that prescribes the target jack-up angle in the case where an arm pulling operation is inputted to the operation lever 26, and that is set such that the target jack-up angle φt is smaller as the posture of the arm 406 has a tip portion of the arm 406 closer to the machine body 1A (i.e., as the length of the arm cylinder 32*b* is elongated). On the other hand, the table at the right in FIG. 9 is a table that prescribes the target jack-up angle in the case where an arm pushing operation is inputted to the operation lever 26, and that is set such that the target jack-up angle φt is larger as the posture of the arm 406 has the tip portion of the arm 406 closer to the machine body 1A (i.e., as the length of the arm cylinder 32*b* is elongated). Note that the arm angle can be calculated from a detection value from the arm IMU 37, and the arm cylinder length can be calculated from a detection value from the stroke sensor (velocity sensor 43). Each of the two tables in FIG. 9 enables calculation of the target jack-up angle by using either one of the arm angle and the arm cylinder length.

Incidentally, determination of the start and the end of excavation can be made by use of an arm operating amount (a detection value of the pressure sensor 44), stroke information concerning the arm cylinder 32*b* obtained from a detection value of the stroke sensor (velocity sensor 43), and the result of jack-up state determination by the jack-up determination section 910. In an excavating operation, excavation is started from a state in which the arm cylinder 32*b* is contracted (the work device 400 is extended), and excavation is finished in a state in which the arm cylinder 32*b* is extended (the work device 400 is folded) by the arm pulling operation. In view of this, when a jacked-up state is determined in a state in which there is an arm pulling operation and the arm cylinder 32*b* is in a contracted state, the current state can be determined as an excavation start state (start of excavation). In addition, when the arm pulling operation is continued and the arm cylinder 32*b* is extended, the current state can be determined as an excavation end state (end of excavation). Note that in an intermediate region between the start and the end of excavation in FIG. 9, the target jack-up angle φt is determined by linear interpolation between the target angles in the excavation start state and the excavation end state (that is, 6 degrees and 0 degrees) according to the stroke of the arm cylinder 32*b*.

<Method for Obtaining Correction Amount Vc>

The command value correction amount calculation section 940 compares target jack-up angle information obtained from the jack-up angle determination section 930 with jack-up angle information obtained from the jack-up angle calculation section 920. When the jack-up angle in practice (actual jack-up angle) φ of the hydraulic excavator 1 is larger than the target jack-up angle φt, a correction amount Vc according to the target operation velocity Vt (the target operation velocity Vta of the boom cylinder 32*a*) is calculated in such a manner that the jack-up angle φ approaches the target jack-up angle φt, and the correction amount Vc is outputted to the operation command value generation section 720. On the contrary, when the actual jack-up angle φ is equal to or less than the target jack-up angle φt, the correction amount Vc is set to 0, and correction of the Pi pressure is not performed. A specific method for obtaining the correction amount Vc will be described below.

When the actual jack-up angle φ is larger than the target jack-up angle φt, the target operation velocity Vt is corrected. The method for obtaining the correction amount Vc in this instance will be described taking as an example an excavating operation conducted by a combined operation of arm pulling based on an operator's operation and boom raising by MC.

In order to reduce the jack-up angle φ during excavation to thereby cause the jack-up angle φ to approach the target jack-up angle φt, it is sufficient to make the velocity higher than the target operation velocity Vta of the boom cylinder 32*a* (boom cylinder velocity in the boom raising direction) calculated by the target operation velocity calculation section 710 to thereby separate the bucket 407 from the ground early. In view of this, when the actual jack-up angle φ is larger than the target jack-up angle φt, the correction amount Vc is calculated by multiplying the target operation velocity Vt (Vta) of the boom cylinder 32*a* by a fixed value of K(Vt), as represented in Formula (1). As a result, the boom raising velocity is enhanced in the case where the machine body 1A is jacked up too much, so that the jack-up angle φ is reduced.

On the other hand, when the target jack-up angle φt is equal to or less than the jack-up angle φ, the target operation velocity Vt (Vta) is not corrected, so that Vc=0 is adopted as represented by Formula (2).

The fixed value K(Vt) for enhancing the boom raising velocity may preliminarily be obtained empirically, or may be determined as a variable value according to the arm operating amount, distance to the target surface, the target operation velocity Vt, and the like. In the present embodiment, correction by the target operation velocity Vt is needed, on the basis of characteristics of the hydraulic system, and, therefore, a function K(Vt) according to the target operation velocity Vt is used.

In the operation command value generation section 720, as represented by Formula (3), the correction amount Vc is added to the target operation velocity Vt calculated by the target operation velocity calculation section 710, and is converted into a corrected Pi pressure by a function F(Vt). The function F(Vt) is a function of the target operation velocity Vt.

$$Vc=Vt\times K(Vt)[\text{jack-up angle}>\text{target jack-up angle}] \quad \text{Formula (1)}$$

$$Vc=0[\text{jack-up angle}\leq\text{target jack-up angle}] \quad \text{Formula (2)}$$

$$Pi=(Vt+Vc)\times F(Vt) \quad \text{Formula (3)}$$

<Control Procedure>

A process flow executed by the controller 20 configured as described above will be described referring to FIG. 8.

Figure 8:
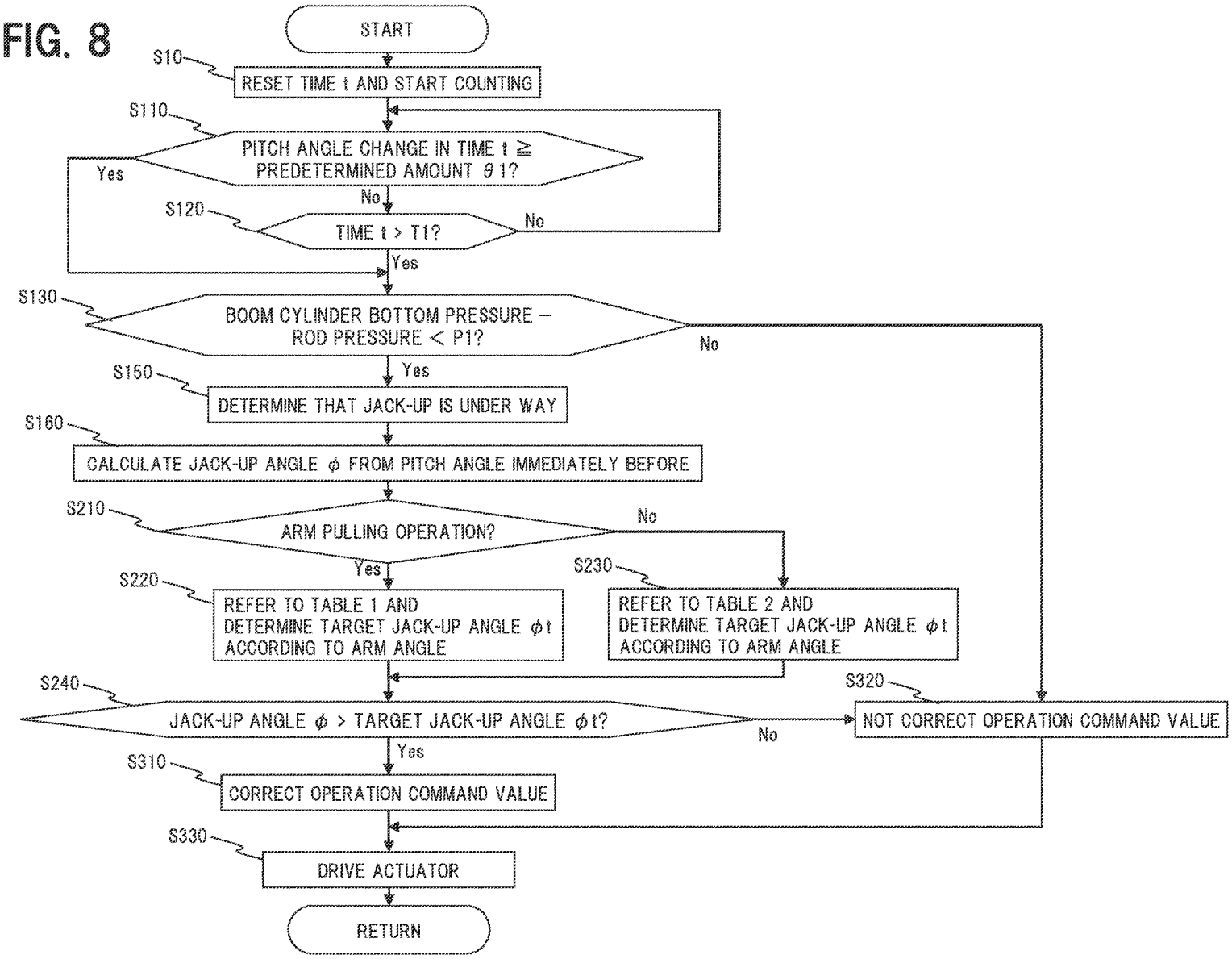
FIG. 8 is a flow chart depicting a procedure according to the embodiment.

When it is confirmed by the pressure sensor 44 that a pushing or pulling operation signal for the arm 406 or a boom lowering operation signal is outputted through the operation lever 26, the controller 20 starts a process of FIG. 8 and proceeds to step S10.

In step S10, the jack-up determination section 910 resets time t to zero, starts counting the time t, and proceeds to step S110.

In step S110, the jack-up determination section 910 determines whether or not the change in the machine body pitch angle in the time t is equal to or more than a predetermined amount θ1. If there is a machine body pitch angle change that is equal to or more than the predetermined amount θ1, it is determined that the machine body 1A may have got in a jacked-up state due to a boom lowering operation, and the control proceeds to step S130. If only a machine body pitch angle change that is smaller than the predetermined amount θ1 has been present in the time t, the control proceeds to S120.

In step S120, the jack-up determination section 910 determines whether or not a predetermined time T1 has elapsed from the start of counting the time t in step S10. Here, if it is determined that the time T1 has elapsed (t>T1), the control proceeds to S130. On the other hand, if it is determined that the time T1 has not elapsed yet, the control returns to step S110.

In step S130, the jack-up determination section 910 determines whether or not the difference (differential pressure) between the bottom pressure Pbb and the rod pressure Pbr of the boom cylinder 32*a* is smaller than a predetermined threshold P1 (that is, whether or not Pbb−Pbr<P1 is established). If the differential pressure is smaller than the threshold P1, the control proceeds to step S150. On the contrary, if the differential pressure is equal to or more than the threshold P1, it is determined that jack-up has not been generated, and the control proceeds to step S320.

Note that the determination in step S130 in the case of having gone through step S120 is preferably performed from the start to the end of an excavating operation. Specifically, it is preferable to adopt a configuration in which, when determination in step S120 is YES and determination thereafter in step S130 is NO, the jack-up determination section 910 determines the presence or absence of an arm operation based on a detection value from the pressure sensor 44, and the control returns to step S130 if the arm operation is being continued, whereas the control proceeds to step S320 if the arm operation has been finished.

In step S150, the jack-up determination section 910 determines that the machine body 1A is in a jacked-up state, and the control proceeds to step S160.

In step S160, the jack-up angle calculation section 920 stores a machine body pitch angle immediately before it is determined in step S150 that the machine body 1A is in a jacked-up state, and calculates the jack-up angle φ of the machine body 1A from the difference between the stored machine body pitch angle and the machine body pitch angle at that point of time.

In step S210, the target jack-up angle determination section 930 determines whether or not an arm operation is a pulling operation, based on an operation signal detected by the pressure sensor 44. If the arm operation is the pulling operation, the control proceeds to step S220. If the arm operation is a pushing operation, the control proceeds to step S230. Note that also when jack-up is generated by boom lowering (that is, when determination in step S110 is YES and, thereafter, determination in step S130 is also YES), an arm pulling or arm pushing operation is normally inputted after the boom lowering, and thus there is no trouble.

In step S220, the target jack-up angle determination section 930 refers to Table 1 in FIG. 9, and determines the target jack-up angle φt according to the arm angle at that time.

In step S230, the target jack-up angle determination section 930 refers to Table 2 in FIG. 9, and determines the target jack-up angle φt according to the arm angle at that time.

In step S240, the command value correction amount calculation section 940 determines whether or not the jack-up angle φ calculated in step S160 is larger than the target jack-up angle φt determined in step S220 or step S230. If the jack-up angle φ is larger than the target jack-up angle φt, the control proceeds to step S310. On the other hand, if the jack-up angle φ is equal to or less than the target jack-up angle φt, the control proceeds to step S320.

In step S310, the command value correction amount calculation section 940 calculates a correction amount Vc concerning the velocity of the boom cylinder 32*a* based on Formula (1), and calculates a corrected Pi pressure for the boom cylinder 32*a* by using the correction amount Vc, the target operation velocity Vt, and Formula (3), and the control proceeds to step S330. Note that for the velocities of the arm cylinder 32*b* and the bucket cylinder 32*c*, the corrected Pi pressure is calculated from the target operation velocity Vt.

In step S320, the command value correction amount calculation section 940 sets the correction amount Vc concerning the velocity of the boom cylinder 32*a* to zero based on Formula (2), and calculates a corrected Pi pressure for the boom cylinder 32*a* by using the target operation velocity Vt and Formula (3), and the control proceeds to step S330. In this case, the corrected Pi pressure is not corrected. Note that for the speeds of the arm cylinder 32*b* and the bucket cylinder 32*c*, the corrected Pi pressure is calculated from the target operation velocity Vt.

In step S330, the driving command section 730 calculates a control current for the proportional solenoid valve 27 to output the corrected Pi pressure calculated in step S310 or S320, and outputs the control current to the corresponding proportional solenoid valve 27, to thereby drive the corresponding hydraulic cylinders 32*a*, 32*b*, and 32*c*.

Note that, in the above description, the flow of FIG. 8 has been started when the arm operation or a boom lowering operation has been made, but the flow may be started only with the boom lowering operation as a trigger. This is because, normally, in an excavating operation, boom lowering is first conducted to move the bucket to an excavation starting position, and thereafter the excavating operation is soon started by an arm pulling operation or pushing operation, and therefore, it is considered that an arm operation is inputted by the time a determination process for the arm operation is performed in step S210, so that the determination in step S210 is not hampered.

<Operation and Effects>

In the hydraulic excavator of the present embodiment configured as described above, when an excavating operation is started by a pulling operation of the arm 405 and jack-up is generated in the machine body 1A due to hard soil, MC of reducing the jack-up angle is not performed until the jack-up angle φ exceeds a target value (target jack-up angle) φt. Therefore, during a period until the jack-up angle exceeds the target value, the operator can intuitively grasp the excavating force state (soil hardness state) from the magnitude of the jack-up angle, and can adjust the excavating force by the operator's own operation. Besides, the target value of the jack-up angle is set in such a manner as to be reduced as the angle of the arm is reduced (that is, as the end of the excavating operation approaches) according to the tendency of the jack-up angle in the case where a skilled operator excavates a hard soil, and the actual jack-up angle semi-automatically approaches the target value by MC according to the progress of the excavating operation. As a result, the excavating force can be maximized in an allowable range at the start of excavation, so that a hard soil can be excavated efficiently. In addition, since excavation at a jack-up angle equivalent to that in the case of skilled operator can be achieved irrespective of the skill of the operator, even an unskilled operator can be expected to effectively excavate a hard soil. Besides, in the case of a skilled operator, the excavating force can be adjusted by the operator's own operation when the actual jack-up angle is equal to or less than the target value, so that lowering in operability does not occur. According to the present embodiment, therefore, operability of the operator when the machine body 1A is in a jacked-up state in the hydraulic excavator in which an area restriction control (MC) is conducted can be kept favorable.

In addition, in the hydraulic excavator mentioned above, the target jack-up angle is set relatively large at the start of excavation, and the jack-up angle is set to approach zero at the end of excavation. Therefore, a transport operation conducted after the end of the excavating operation can be started swiftly, and lowering in work efficiency can be prevented.

Besides, in the method in which the presence or absence of generation of jack-up is determined based on the differential pressure between the bottom-side oil chamber and the rod-side oil chamber of the boom cylinder 32*a*, there has been a problem that in the case of a sudden boom lowering from a state in which the work device 400 stands still, a differential pressure value similar to that upon generation of jack-up may arise even when jack-up is not actually generated, and thus erroneous determination of jack-up may occur. In the present embodiment, however, it is determined that a jack-up angle is generated in the case where the machine body pitch angle has changed by an amount equal to or more than a predetermined amount during a period until the predetermined time T1 elapses from a boom lowering operation, and, therefore, generation of such an erroneous determination can be prevented.

<Modification>

Figure 10:
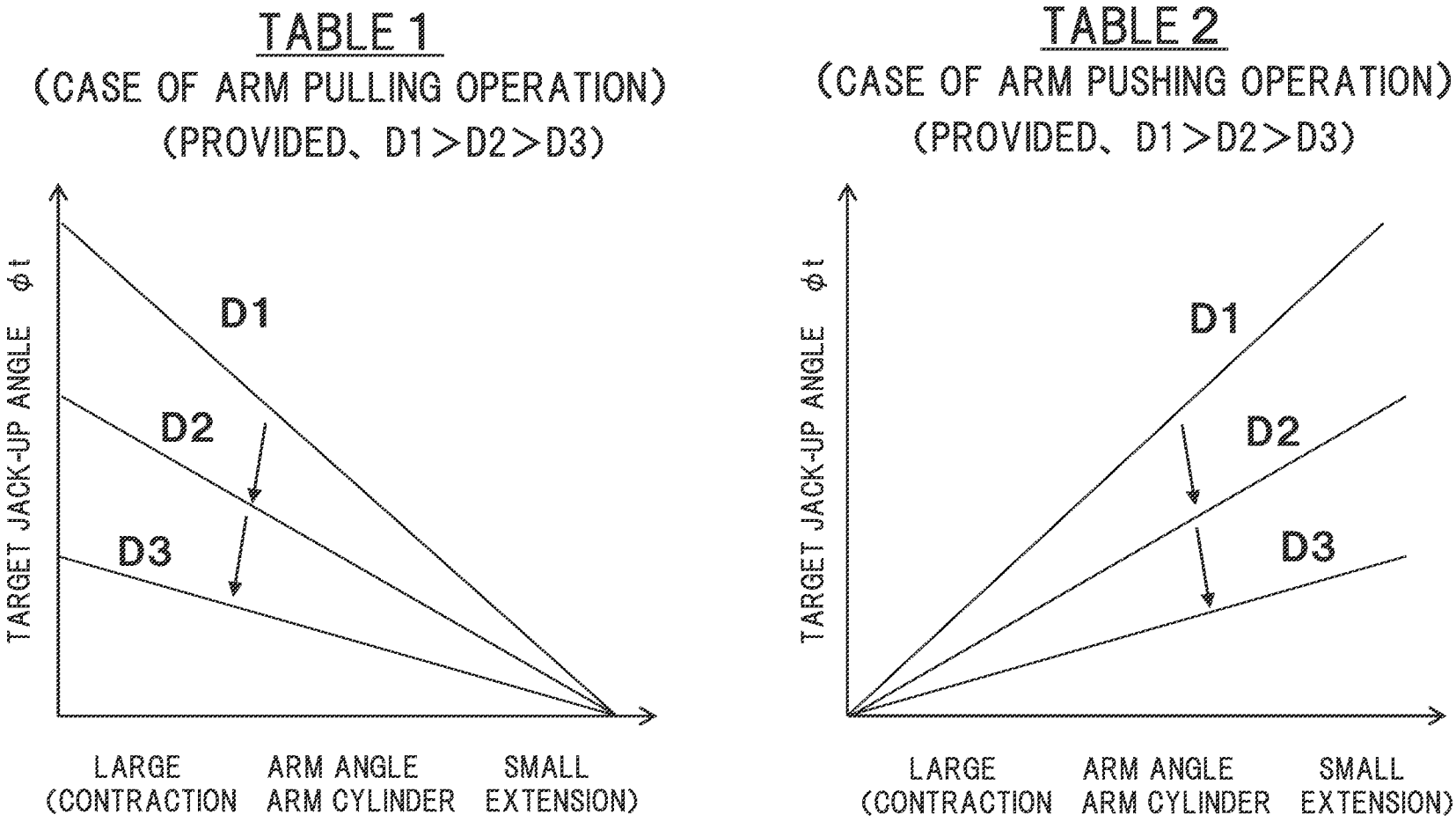
FIG. 10 is a diagram depicting the correlation between an arm angle, a target jack-up angle φt, and a target surface distance D.

Incidentally, the target jack-up angle φt is preferably set to be smaller as the target surface distance D is smaller, as depicted in FIG. 10. If the machine body 1A is jacked up too much, over-excavation beyond the target surface 60 may occur upon sudden softening of the soil, or swift transition to a transport operation upon the end of excavation may be impossible and, hence, work efficiency may be lowered. When the target jack-up angle φt is set in the above-mentioned manner, however, it is ensured that, in the case where the target surface distance D is small and the distance between the target surface 60 and the bucket claw tip 407*a* is close, the target jack-up angle φt is set small and the actual jack-up angle is suppressed; therefore, generation of a situation in which the target surface 60 is over-excavated can be prevented. In addition, in the case where the target surface distance D is large and the distance between the target surface 60 and the bucket claw tip 407*a* is large, the excavating force can be increased by jack-up, so that enhanced work efficiency can be expected.

<Others>

In the foregoing, there have been parts based on the assumption that only an arm operation is conducted at the time of an excavation work, for simplification of the description of the area restriction control executed by the controller 20. However, needless to say, the process executed by the controller 20 and the programs (the sections in the controller 20 of FIG. 4) are configured such that the area restriction control functions normally even if there is a boom operation or a bucket operation.

In addition, while MC is applied to only the boom cylinder 32*a* (boom 405) in the foregoing, MC may also be configured to be applied to the arm cylinder 32*b* and the bucket cylinder 32*c*. In this case, in the command value correction amount calculation section 940, the correction amount Vc is calculated for a target operation velocity Vt of a cylinder to which MC is applied.

Besides, the processing of steps S10, S110, and S120 in FIG. 8 above may be omitted.

Note that the present invention is not limited to the above embodiments, and includes various modifications in such ranges as not to depart from the gist of the invention. For example, the present invention is not limited to one that includes all the configurations described in the above embodiment, but may include those in which some of the configurations is deleted. In addition, some of the configurations according to a certain embodiment may be added to or be used in place of the configurations according to another embodiment.

Besides, the configurations concerning the above controller (controller 20) and the functions and executing processes of the configurations may be realized in whole or in part by hardware (for example, designing logics for executing the functions in the form of an integrated circuit). In addition, the configurations of the above controller may be programs (software) which, by being read out and executed by a calculation processing device (e.g., CPU), realize the functions according to the configurations of the controller. Information concerning the programs can be stored, for example, in a semiconductor memory (a flash memory, an SSD, etc.), a magnetic recording device (a hard disk drive, etc.), a recording medium (a magnetic disk, an optical disk, etc.), and so on.

Besides, in the description of the embodiments above, of the control lines and information lines, those construed to be necessary for explanation of the embodiments have been described, but all the control lines and information lines concerning the product are not necessarily described. It may be considered that, in practice, substantially all the configurations are connected to one another.

DESCRIPTION OF REFERENCE CHARACTERS

1: Hydraulic excavator
20: Controller
21: Engine
21*c*: Bucket cylinder
22: Engine control unit (ECU)
23: Hydraulic pump
24: Gear pump (pilot pump)
25: Control valve
26: Operation lever (operation device)
27: Proportional solenoid valve
28: Swing hydraulic motor
32*a*: Boom cylinder
32*b*: Arm cylinder
32*c*: Bucket cylinder
33: Track hydraulic motor
40: Antenna
41: Pressure sensor
42: Pressure sensor
42BBP: Boom bottom pressure sensor
42BBP: Boom bottom pressure sensor
43: Velocity sensor

44: Pressure sensor
50: Target surface setting device
51: Engine control dial
60: Target surface
400: Front work device (work device)
401: Track structure
402: Swing structure
403: Cab
405: Boom
406: Arm
407: Bucket
407*a*: Bucket claw tip
700: Target surface distance calculation section
710: Target operation velocity calculation section
720: Operation command value generation section
730: Driving command section
740: Position calculation section
810: Cylinder pressure sensing section
820: Machine body pitch angle sensing section
830: Front posture sensing section
910: Jack-up determination section
920: Jack-up angle calculation section
930: Target jack-up angle determination section
940: Command value correction amount calculation section

The invention claimed is:

1. A work machine comprising:

a machine body including a track structure and a swing structure;

a work device having a boom and an arm and mounted to the swing structure;

a plurality of hydraulic cylinders that are driven by hydraulic fluid delivered from a hydraulic pump and that operate the work device;

an operation device that gives an instruction on an operation of the work device according to an operation of an operator; and a controller that performs an area restriction control for controlling at least one hydraulic cylinder of the plurality of hydraulic cylinders in such a manner that the work device is located on or on an upper side of an optionally set target surface during operation of the operation device, wherein if a jack-up angle as an inclination angle of the machine body relative to a ground is larger than a preset target value, the controller, in performing the area restriction control, corrects the control of the at least one hydraulic cylinder in such a manner that the jack-up angle approaches the target value, and the target value is set in such a manner as to vary according to posture of the arm.

2. The work machine according to claim 1, wherein if a pulling operation for the arm is inputted to the operation device, the controller sets the target value to be smaller as the posture of the arm is such that a tip portion of the arm is closer to the machine body.

3. The work machine according to claim 1, wherein if a pushing operation for the arm is inputted to the operation device, the controller sets the target value to be larger as the posture of the arm is such that a tip portion of the arm is closer to the machine body.

4. The work machine according to claim 1, wherein if a pulling operation for the arm is inputted to the operation device, the controller sets the target value to be smaller as length of an arm cylinder for driving the arm, of the plurality of hydraulic cylinders, is elongated.

5. The work machine according to claim 1, wherein if a pushing operation for the arm is inputted to the operation device, the controller sets the target value to be larger as length of an arm cylinder for driving the arm, of the plurality of hydraulic cylinders, is elongated.

6. The work machine according to claim 1, wherein the controller further sets the target value to be smaller as the distance between the work device and the target surface becomes shorter.

7. The work machine according to claim 1, wherein if a difference between a bottom pressure and a rod pressure of a boom cylinder for driving the boom, of the plurality of hydraulic cylinders, is smaller than a predetermined pressure threshold, after a predetermined period of time has elapsed from a time when a lowering operation for the boom is started by the operation device, the controller determines that the machine body is in a jacked-up state.

8. The work machine according to claim 7, wherein if a change in inclination angle of the machine body becomes equal to or more than a predetermined change threshold and the difference between the bottom pressure and the rod pressure of the boom cylinder for driving the boom, of the plurality of hydraulic cylinders, is smaller than the predetermined pressure threshold, during a period until the predetermined period of time elapses from the time when the lowering operation for the boom is started by the operation device, the controller determines that the machine body is in a jacked-up state.

9. The work machine according to claim 1, further comprising: an inclination angle sensor that detects an inclination angle of the machine body, wherein the controller calculates the jack-up angle, based on a value detected by the inclination angle sensor immediately before a time when the machine body is determined to be in a jacked-up state.

* * * * *